US006851627B2

(12) United States Patent
Hashish et al.

(10) Patent No.: US 6,851,627 B2
(45) Date of Patent: Feb. 8, 2005

(54) MULTIPLE SEGMENT HIGH PRESSURE FLUIDJET NOZZLE AND METHOD OF MAKING THE NOZZLE

(75) Inventors: Mohamed A. Hashish, Bellevue, WA (US); Steven J. Craigen, Auburn, WA (US)

(73) Assignee: Flow International Corporation, Kent, WA (US)

( * ) Notice: Subject to any disclaimer, the term of this patent is extended or adjusted under 35 U.S.C. 154(b) by 132 days.

(21) Appl. No.: 09/919,778

(22) Filed: Jul. 31, 2001

(65) Prior Publication Data

US 2003/0029934 A1 Feb. 13, 2003

(51) Int. Cl.[7] ..... B05B 7/06
(52) U.S. Cl. ..... 239/424; 239/596; 239/600
(58) Field of Search ..... 239/434, 424, 239/596, 600

(56) References Cited

U.S. PATENT DOCUMENTS

| | | | | |
|---|---|---|---|---|
| 1,703,029 A | * | 2/1929 | Fairchild | 451/102 |
| 1,940,972 A | * | 12/1933 | Schwartzkopf | 451/90 |
| RE23,064 E | * | 12/1948 | Tirrell | 451/90 |
| 2,666,279 A | | 1/1954 | Chalom | |
| 3,212,217 A | * | 10/1965 | Furgason | 239/424 |
| 3,419,220 A | * | 12/1968 | Goodwin et al. | 239/596 |
| 3,906,672 A | | 9/1975 | Kobayashi | |
| 4,587,772 A | | 5/1986 | Griffiths | |
| 5,004,153 A | * | 4/1991 | Sawyer | 239/81 |
| 5,320,289 A | * | 6/1994 | Hashish et al. | 239/600 |
| 5,643,058 A | | 7/1997 | Erichsen et al. | |
| 5,785,582 A | | 7/1998 | Stefanik et al. | |
| 6,425,805 B1 | * | 7/2002 | Massa et al. | 239/600 |

FOREIGN PATENT DOCUMENTS

| | | |
|---|---|---|
| CH | 131161 | 1/1929 |
| EP | 0 070 002 A1 | 1/1983 |

* cited by examiner

*Primary Examiner*—Dinh Q. Nguyen
(74) *Attorney, Agent, or Firm*—Seed Intellectual Property Law Group PLLC

(57) ABSTRACT

A high-pressure fluidjet nozzle is formed from a plurality of segments joined together, for example, by a metal sleeve. Axial bores provided in the segments align to form an axial bore extending through the nozzle. The number, material, and outer and inner dimensions of the segments can be varied to provide a nozzle with desired performance characteristics. Spaces can be provided between the segments to form chambers with auxiliary ports connected to the chambers to allow monitoring and modulation of the jet.

16 Claims, 3 Drawing Sheets

MULTIPLE SEGMENT HIGH PRESSURE FLUIDJET NOZZLE AND METHOD OF MAKING THE NOZZLE

BACKGROUND OF THE INVENTION

1. Field of the Invention

This invention relates to a segmented mixing tube or nozzle for use in a high-pressure fluidjet system, and to a method of making a segmented mixing tube.

2. Description of the Related Art

The cutting or cleaning of materials using a high-pressure waterjet is well known. Often, high-pressure waterjet systems also incorporate abrasive particles to form an abrasive waterjet. The abrasives are typically entrained into a high-pressure fluidjet in a mixing tube or nozzle.

Abrasive waterjet mixing tubes or nozzles are currently made out of a hard material such as tungsten carbide or tungsten carbide composite. These tubes are relatively long with a length to internal bore diameter ratio approaching 100. Higher length to diameter ratios will result in improved jet coherency and longer service life. However, there is a limitation on the manufacture of these tubes due to the relatively large length to diameter ratio requirement. For example, a typical length may be 3 inches with a bore of 0.03 inch. Reducing the bore diameter to 0.015 inches, for example, poses a significant manufacturing challenge. This invention is directed to a segmented nozzle for overcoming the manufacturing problem and for adding additional performance benefits to the nozzle.

BRIEF SUMMARY OF THE INVENTION

This invention is directed to a nozzle for a high-pressure fluidjet system or for a high-pressure abrasive waterjet system, the nozzle being formed of multiple segments. The segments are each shorter in length then a typical nozzle and are stacked together with their internal bores in alignment to form a continuous passage through the nozzle. The segments may be coupled together in any one of a variety of ways. For example, the segments may be assembled together in a metal tube by shrink fitting the tube around the segments, press-fitting a tube around the segments, or by metal spray forming.

Because the individual segments are fabricated in limited length sections, their internal bore is more easily and accurately drilled to a desired diameter. Stacking a selected number of segments will allow the length of the nozzle to be controlled to a desired length. By forming the nozzle from shorter segments, the external dimension of the segments may be smaller, providing a significant savings in material cost. Greater flexibility may also be achieved by structuring segments with varying internal bores from top to bottom, so that the internal bore diameter of the nozzle can be varied from entry to exit of the nozzle, either to be convergent or divergent. The segments within a nozzle can also be made from different materials, if desired.

In some embodiments, spaces are provided between the segments for entraining air, abrasives, or fluids into the jet, for example to modulate the jet. This entrainment or injection of fluids or abrasives can be accomplished at different locations or along several axial sections of the nozzle. The segments may also be spaced to create ports and allow the placement of sensors at desired locations along the length of the nozzle.

The invention also is directed to the method of making a high-pressure fluidjet nozzle using a plurality of segments, as described above.

DETAILED DESCRIPTION OF THE INVENTION

Figure 1:
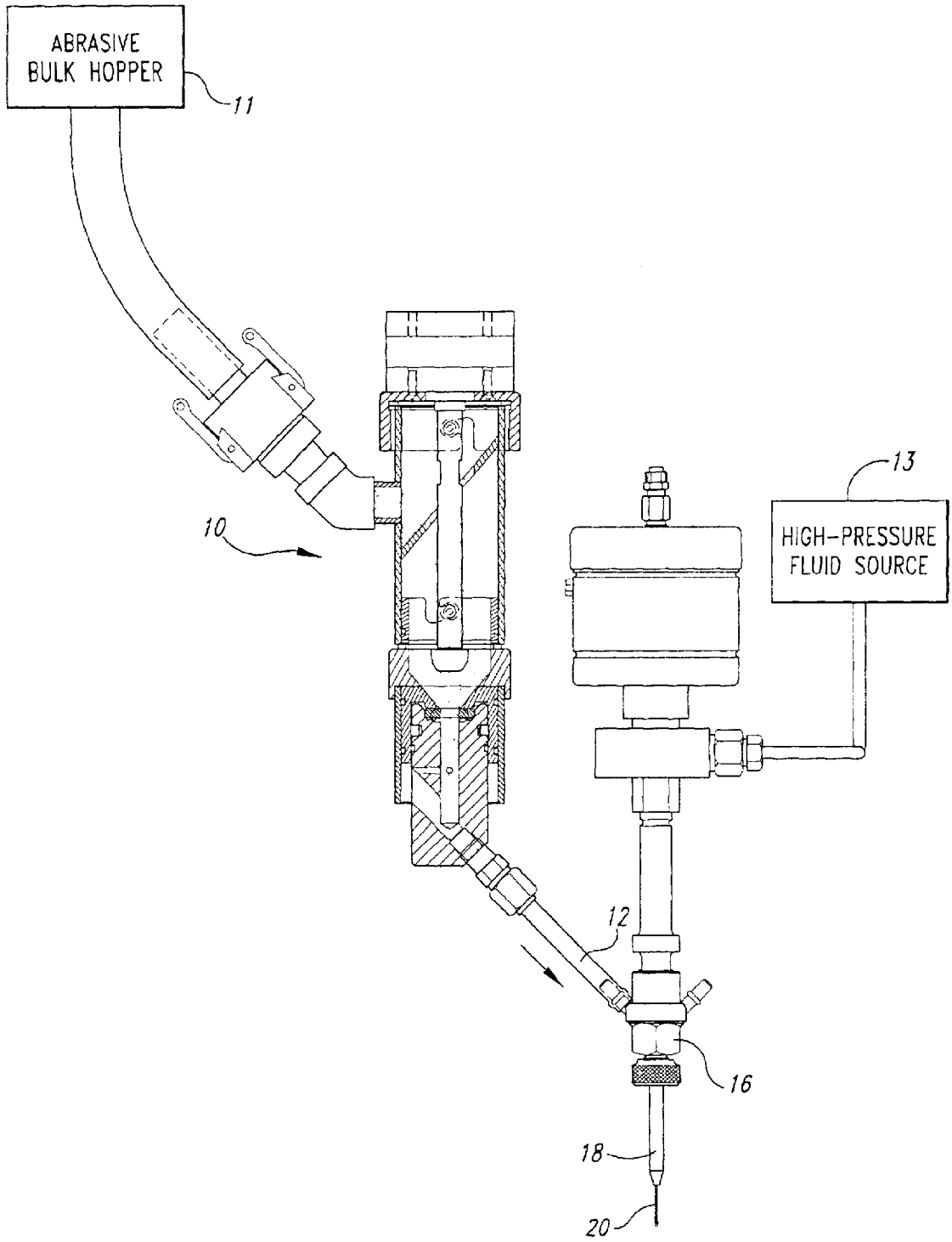
FIG. 1 is a partial-sectional elevational view of an abrasive fluidjet system.

While a segmented nozzle 18, provided in accordance with the present invention, may be used in a variety of systems, it is shown in use with an abrasive fluidjet system 10 in FIG. 1, for purposes of illustration. It will be understood, however, that the nozzle has equal applicability to fluidjet systems that do not use abrasives, or that form a fluidjet or abrasive fluidjet in ways other than those shown in the illustrations.

Figure 2:
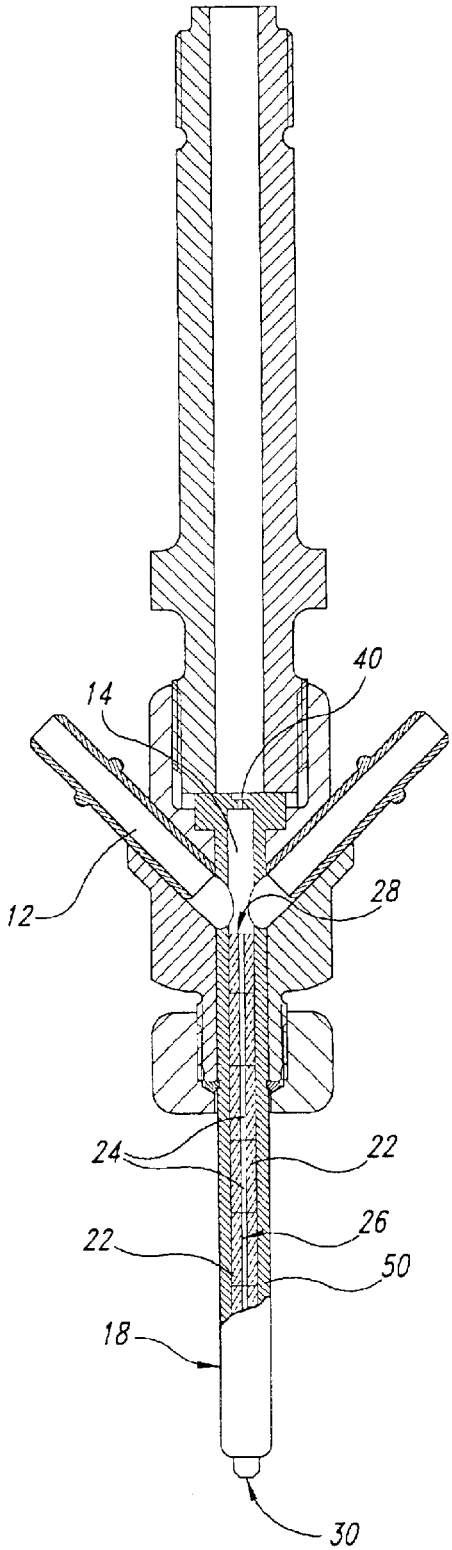
FIG. 2 is a cross-sectional view of a portion of the system shown in FIG. 1 and illustrating one embodiment of a segmented nozzle of this invention.
Figure 3:
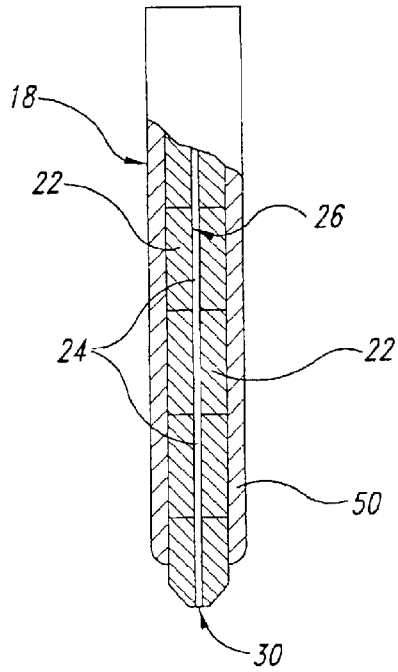
FIG. 3 is another sectional, elevational view of the embodiment of a segmented nozzle shown in FIG. 2.

The overall construction and operation of abrasive fluidjet systems is well known and the details need not be described herein. One available abrasive fluidjet system, for example, is shown in U.S. Pat. No. 5,643,058, assigned to Flow International Corporation, the assignee of the present invention. Briefly, however, in an abrasive fluidjet system 10 as shown in FIGS. 1 and 2, a volume of abrasive particles is fed from an abrasive bulk hopper 11 into a feed line 12 and then into a mixing chamber 14 of a cutting or cleaning head 16. The abrasive is entrained into a high-pressure jet of fluid, preferably water, generated by forcing a quantity of fluid from a high-pressure fluid source 13 through orifice 40. The abrasive particles and high-pressure fluidjet mix as they pass down the length of mixing tube or nozzle 18, leave nozzle 18 as a high-pressure abrasive fluidjet 20.

Traditionally, mixing tubes have a length to bore diameter ratio (L/D ratio) around 100. For example, a nozzle using conventional construction techniques may be three inches long with an inner bore diameter of about 0.03 inch. It is believed that even higher L/D ratios are desirable; however, manufacturing limitations of drilling a bore in a unitary nozzle make increased ratios challenging to near impossible.

It is a unique feature of the present invention that the nozzle 18 is made from multiple segments 22, as best shown in FIGS. 2–5. Each segment 22 has an internal bore 24. The segments 22 are stacked with their bores 24 all axially aligned to provide a continuous fluid passage 26 through the nozzle 18, the continuous fluid passage 26 having an entry 28 and an exit 30. The segments can be coupled together by several methods. One preferred technique is to shrink fit a metal sleeve 50, using commonly known shrink-fitting techniques, around the stacked segments. While various metals may be used, in a preferred embodiment, the sleeve 50 is formed of steel or aluminum. Another method is to slide the segments into a slide-fit tube and use an adhesive such as epoxy to keep them in place. Also, the segments can be mounted on a tensioned wire and sprayed with a metal coating to coat an outside surface of the segments, thus bonding them together. The metal sleeve will hold the segments in a tight stack and will also protect the nozzle from damage that can occur if the nozzle hits an object.

Because the drilling of a bore in a short segment can be done more accurately than in a long segment, the size of the bore can be reduced, allowing either the overall length of the nozzle 18 to be reduced for a given L/D ratio, or the L/D ratio to be made greater, as desired. As discussed previously, it is believed that system performance is improved by increasing the L/D ratio, for example by improving jet coherency and nozzle service life. However, the maximum attainable L/D ratio was previously limited by the manufacturing constraints of drilling a small bore through a long nozzle. By forming the nozzle from segments, drilling accuracy is improved, allowing smaller diameter bores to be formed. Thus, the present invention allows nozzles to have an improved L/D ratio previously not possible. For example, a conventional mixing tube may have a length of 3 inches and an internal bore diameter of 0.03 inch. In accordance with the present invention, the nozzle 18 is formed of multiple segments, each having a length of 0.125–0.75 inch, and an inner bore diameter of 0.005–0.030 inch. It will be understood that the length, outside diameter and bore diameter of the segments may be varied, as desired. Table 1 below illustrates several possible geometries provided in accordance with the present invention. It will be understood, however, that these are merely illustrative of many different possible geometries provided in accordance with the invention.

TABLE 1

| Segment Length (Inch) | Bore Diameter (Inch) | Overall Nozzle Length (Inch) | Nozzle L/D |
|---|---|---|---|
| 0.125 | 0.005 | 1 | 200 |
| 0.25 | 0.010 | 1.5–2 | 150–200 |
| 0.375 | 0.015 | 3–4.5 | 200–300 |
| 0.5 | 0.020 | 4 | 200 |

Also, by forming the nozzle from shorter segments, the external diameter or dimension of the segments 22 may be reduced, providing a significant savings in material costs. For example, a typical unitary nozzle may be 0.25 inch in external diameter. In accordance with the present invention, given the increased accuracy and ease of machining, the external dimension of each segment can be reduced to less than 0.25 inch, for example to 0.125 inch, providing reduced material costs.

Figure 4:
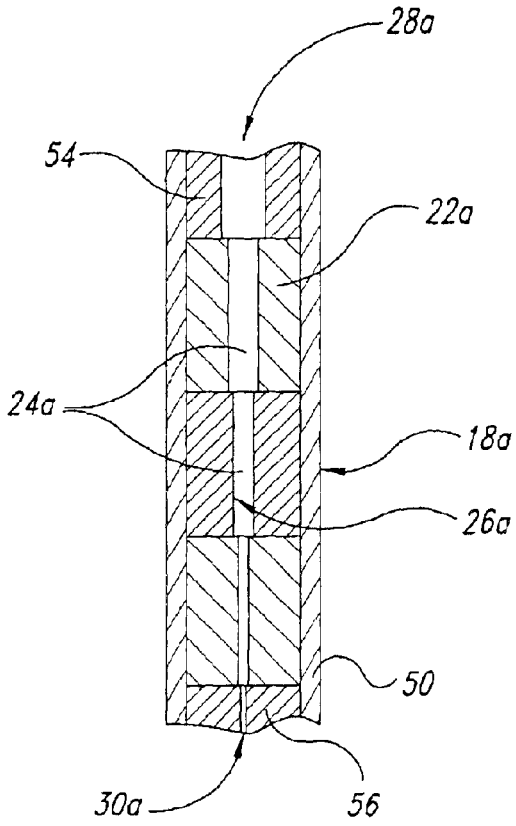
FIG. 4 is an alternative form of a segmented nozzle, provided in accordance with the present invention.

In an alternative nozzle 18*a* shown in FIG. 4, the size of the internal bore 24*a* of each segment 22*a* can be varied to obtain more flexibility in the construction of the nozzle and the performance of the fluidjet 20. While FIG. 4 shows the diameters of the bores 24*a* getting smaller from the entry 28*a* of the nozzle to the exit 30*a* to form a converging fluid passage 26*a*, the diameters of the holes can also by made smaller to larger from entry to exit to form a diverging fluid passage. Alternatively, any other combination of hole diameters can be used to achieve a selected performance of the fluidjet 20.

The inner bore diameter or dimension of the segments may also vary from segment to segment. For example, the inner diameter of the uppermost segment may be made larger than the inner diameter of the remaining segments. This may be advantageous for several reasons. For example, having the upper section be of larger inner diameter will facilitate the abrasive entrainment process. Also, a nozzle geometry provided with a larger bore at the top is likely not to change or wear over time as quickly as a single, small bore nozzle.

The overall length of the nozzle may also be selected by coupling a selected number of standardized segments together, in accordance with the invention. The segmented nozzle 18 may also be formed together with the orifice 40, as shown in FIG. 2, to provide a single assembly. This will provide better alignment of the waterjet stream inside the mixing tube and reduce the number of components.

If desired, the segments 22 can also be manufactured from different materials, for example, a first segment 54 and/or a last segment 56 can be made from diamond or other hard material to achieve a desired wear performance. Other segments can be made of tungsten carbide or tungsten carbide composites. A material sold by Kenna Metal (Boride Products Division), under the trade name ROCTEC®, may also be used.

Figure 5:
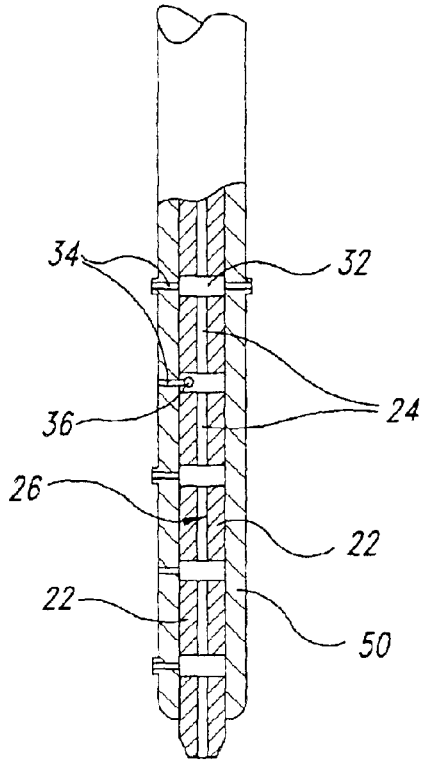
FIG. 5 is another alternative form of a segmented nozzle, provided in accordance with the present invention.

As best shown in FIG. 5, some or all of the segments 22 can be spaced axially from one another as at chambers 32 to provide for auxiliary ports 34. The nozzles can be spaced in many ways. For example, the segments 22 may be spaced apart by washers. Alternatively, the segments 22 may be press-fit into a tube to known distances. Ports 34 can vary in size and be used for introducing other material into the nozzle, such as air, water, other fluids or abrasives. The ports can also be used for housing sensors 36, such as a pressure or temperature sensor.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A high-pressure fluid nozzle comprising:

a plurality of segments, each segment having an axial bore extending therethrough, the bore of each segment being aligned with the bore of each other segment to form a continuous fluid passage through the plurality of segments, and a containment sleeve formed around the segments by metal spray forming for coupling the segments together; and wherein at least one of the segments is spaced axially from an adjacent segment to form a chamber, and including at least one sensor in the chamber.

2. The nozzle of claim 1 wherein the sensor senses a pressure of a fluidjet.

3. The nozzle of claim 1 wherein the sensor senses a temperature of a fluidjet.

4. A high-pressure fluid nozzle comprising:

a plurality of segments, each segment having an axial bore extending therethrough, the bore of each segment being aligned with the bore of each other segment to form a continuous fluid passage through the plurality of segments;

a chamber formed between two adjacent segments when at least one of the segments is spaced axially from an adjacent segment to form the chamber;

at least one sensor located within the chamber; and a containment sleeve for coupling the segments together.

5. The nozzle of claim 4 wherein the nozzle has a selected length achieved by coupling together a selected number of the segments each segment having a selected length.

6. The nozzle of claim 5 wherein the length of each segment is 0.125–0.75 inch.

7. The nozzle of claim 4 wherein the segments are of different inner dimensions.

8. The nozzle of claim 7 wherein the inner diameter of an uppermost segment is greater than the inner diameter of the remaining segments.

9. The nozzle of claim 4, at least one of the segments spaced axially from an adjacent segment to form a chamber, and including at least one sensor in the chamber.

10. The nozzle of claim 9 wherein the sensor senses a pressure of a fluidjet.

11. The nozzle of claim 9 wherein the sensor senses a temperature of a fluidjet.

12. The nozzle of claim 4 wherein the bores of the segments are of varying diameter.

13. The nozzle of claim 12 wherein the bores of the segments near an inlet end of the nozzle are larger than the bores of the segments near a discharge end of the nozzle to form a converging fluid passageway.

14. The nozzle of claim 12 wherein the bores of the segments near an inlet end of the nozzle are smaller than the bores of the segments near a discharge end of the nozzle to form a diverging fluid passageway.

15. The nozzle of claim 4 wherein the segments are formed from different selected materials to achieve a desired wear performance.

16. The nozzle of claim 4, further including a jewel orifice coupled to the nozzle upstream of an inlet end of the nozzle.

* * * * *